US006521873B1

(12) United States Patent
Cheng et al.

(10) Patent No.: US 6,521,873 B1
(45) Date of Patent: Feb. 18, 2003

(54) HEATING SUBSTRATE

(75) Inventors: Chung-Chi Cheng, Taichung (TW); Wen-Chang Shih, Taichung (TW)

(73) Assignee: Likely Medical International Inc., Taichung (TW)

( * ) Notice: Subject to any disclaimer, the term of this patent is extended or adjusted under 35 U.S.C. 154(b) by 0 days.

(21) Appl. No.: 10/045,003

(22) Filed: Jan. 15, 2002

(51) Int. Cl.[7] ..... H05B 3/54

(52) U.S. Cl. ..... 219/528; 219/549

(58) Field of Search ..... 219/528, 549, 219/535, 542, 544, 545, 548, 212, 217

(56) References Cited

U.S. PATENT DOCUMENTS 5,824,996 A * 10/1998 Kochman et al. ..... 219/529

* cited by examiner

*Primary Examiner*—Teresa Walberg
*Assistant Examiner*—Vinod D Patel
(74) *Attorney, Agent, or Firm*—Bacon & Thomas

(57) ABSTRACT

A heating substrate useful in an electronic blanket or a hot compressing pad is provided. The heating substrate includes a flexible fiber layer and a graphite thread. The graphite thread is wound on the flexible fiber layer with a given winding distance. The graphite thread is stitched onto the flexible fiber layer by use of a positioning wire. A slot is formed appropriately on the flexible fiber layer for forming a given number of the graphite threads and the layer thereunder as a unit of the heating substrate of the invention. Thereby, the thick flexible fiber layer is prevented from being distributed unevenly when in use.

4 Claims, 3 Drawing Sheets

HEATING SUBSTRATE

FIELD OF THE INVENTION

The invention provides a heating substrate which has soft feeling, less weight and is foldable.

BACKGROUND OF THE INVENTION

A conventional electric blanket, as shown in FIG. 1, includes thermal insulators 1 each having a film 2 thereon. The heating wire 3 formed by winding a filament 3*a* made of nickel chromium alloy or iron chromium alloy around a fiber core 3*b* and encapsulating the filament 3*a* and the fiber core 3*b* with plastic wrappings 3*c*. The heating wire 3 is wound in a form of "S" on one of the films 2. One fiber net 4 is attached on the heating wire 3. Thermal insulators 1 cover the fiber net 4, such that the heating wire 3 is between the thermal insulators 1. Finally, the whole structure is encapsulated with plastics 5 to achieve the conventional electric blanket.

The heating wire 3 made of nickel chromium alloy or iron chromium alloy is rigid. The larger the number of the filament 3*a* is, the more rigid the heating wire 3 is. Therefore, the electric blanket obtained in the way recited above cannot fit a user's body and cannot give soft feeling to the user when in use. Additionally, the filament 3*a* made of nickel chromium alloy or iron chromium alloy increases the weight of the electric blanket and the difficulty to fold. Furthermore, the inner thermal insulators 1 are not bound to the plastic 5, often resulting in the inner thermal insulator being distributed unevenly.

SUMMARY OF THE INVENTION

A principal objective of the invention is to provide a heating substrate that includes a thick flexible fiber layer and a plurality of flexible graphite threads. Each of the flexible graphite threads consists of a plurality of flexible graphite fibers. The graphite threads are wound and stitched on the thick flexible fiber layer. The substrate formed by graphite fibers has less weight and is not easy to be broken. Furthermore, a plurality of slots is formed on the thick flexible fiber layer for binding external wrappings. Thereby, the flexible fiber layer is prevented from being distributed unevenly.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention and, incorporated herein, constitute a part of the invention disclosure. A brief introduction of the drawings is as follows.

DESCRIPTION OF THE PREFERRED EMBODIMENTS

A detailed description of the invention is now illustrated with reference to FIG. 2 through FIG. 5 that show various views of an embodiment of the invention.

Figure 1:
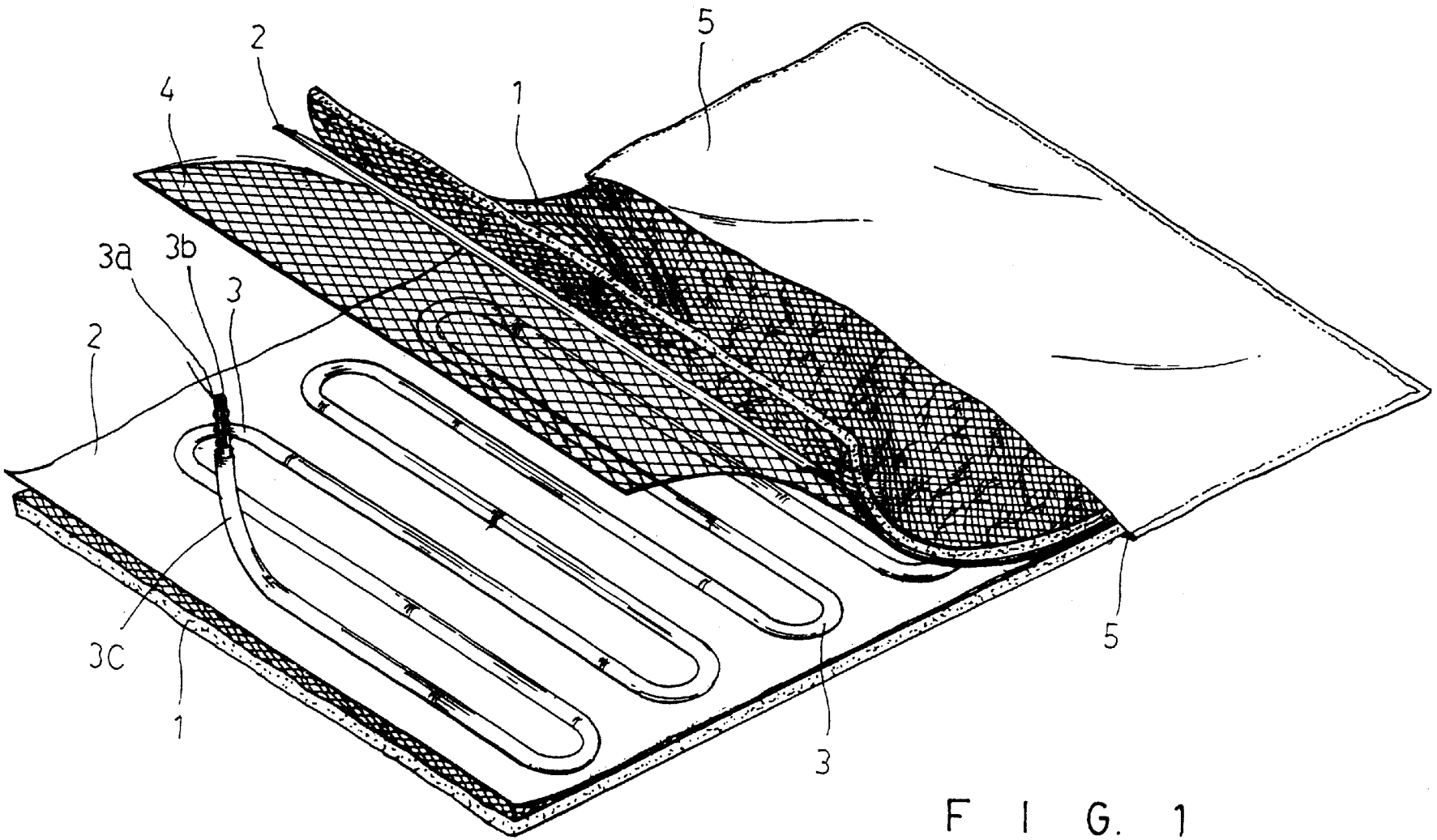
FIG. 1 PRIOR ART
FIG. 1 is a perspective view of a conventional structure.
Figure 2:
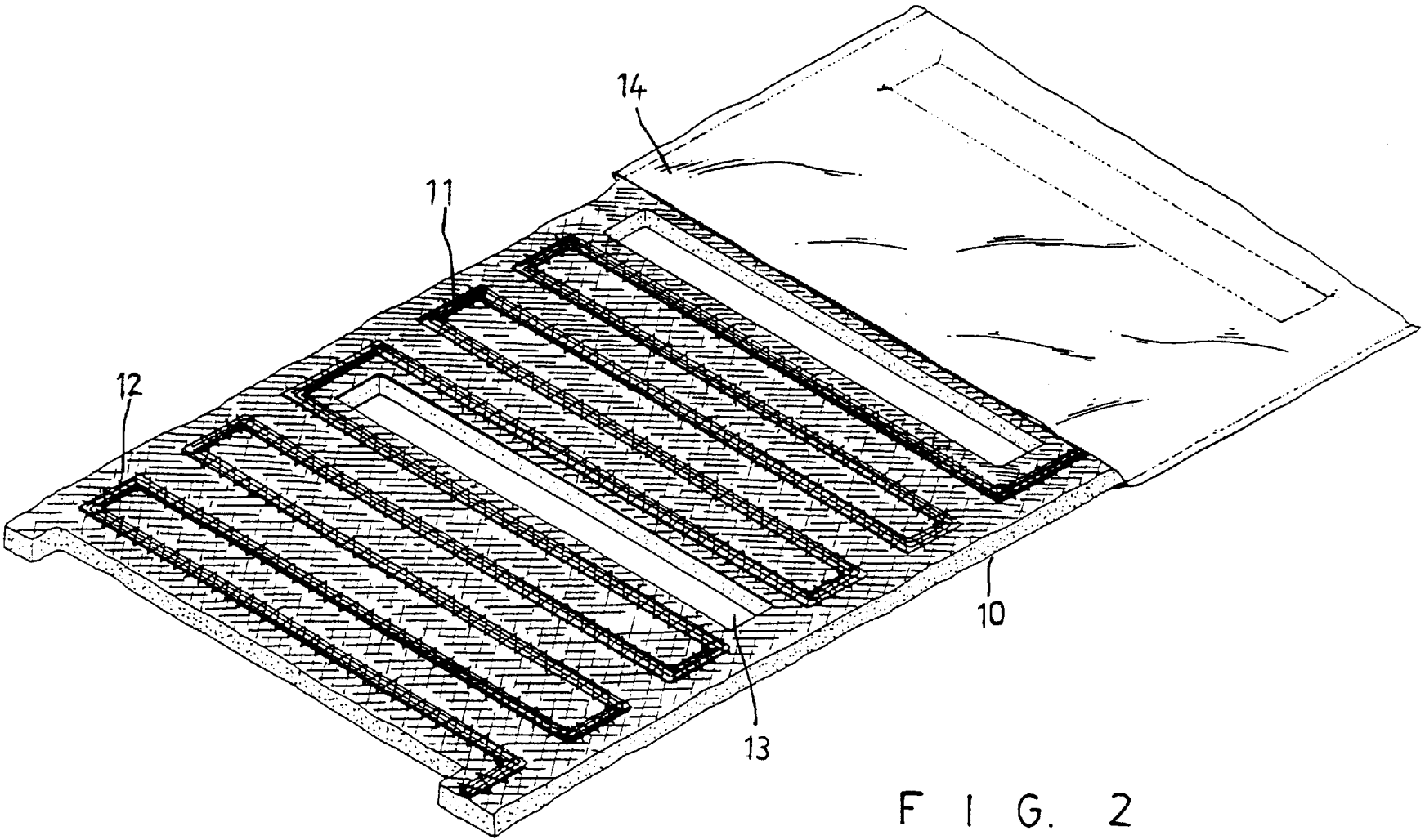
FIG. 2 is a schematic view of a heating substrate according to one preferred embodiment of the invention.
Figure 3:
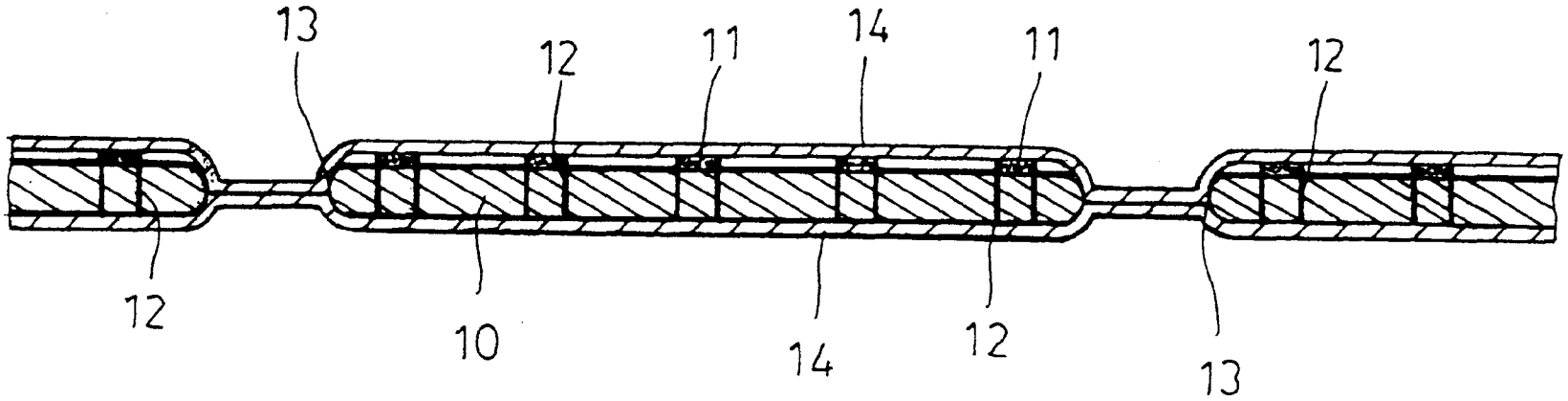
FIG. 3 is a cross-sectional view of the heating substrate according to one referred embodiment of the invention.

With reference to FIG. 2 and FIG. 3, a heating substrate of the invention includes a thick flexible fiber layer 10, and a plurality of graphite threads 11. Each of the graphite threads 11 is formed by a plurality of graphite fibers and made flat. The graphite threads 11 are wound in a form of "S" on the thick flexible graphite fiber layer 10, with a given winding distance. A positioning wire 12 passes through the graphite threads 11 at an angle and stitched on the graphite threads 11, thereby fixing the graphite threads 11 upon the thick flexible fiber layer 10. A plurality of slots 13 is formed on the thick flexible fiber layer 10 and spaced apart one another. The slots 13 are formed in parallel to the graphite thread 11 and located between adjacent graphite threads 11. Plastic wrappings 14 enclose the whole layer 10. The portions of the wrappings 14 on and under the slots 13 are bound together to seal the slots 13, thereby forming a given number of the graphite threads 11 and the layer 10 thereunder as a unit of the heating substrate of the invention. Forming a given number of the graphite threads 11 and the layer 10 thereunder as a unit of the heating substrate of the invention prevents the thick flexible fiber layer 10 from being distributed unevenly when in use.

In view of the foregoing, the heating substrate of the invention provides the following advantages over the prior art:

1. The graphite threads 11 have superior flexibility, toughness and heating performance. The graphite threads 11 are wound on the thick flexible fiber layer 10 without any enamel insulation. Therefore, the heating substrate of the invention can be used to form an electric blanket that has less weigh but good flexibility. When the electric blanket formed by the heating substrate of the invention covers a user' body, the electric blanket perfectly fits to the user's body and gives soft feelings to the user.

2. The graphite thread 11 has no enamel insulation thereon, and is therefore easily folded without risk of breaking the graphite threads 11.

3. The slots 13 on the thick flexible fiber layer 10 are used for binding the wrappings 14 on and under the slots to form a given number of the graphite threads 11 and the layer 10 thereunder as a unit of the heating substrate of the invention. Thereby, the thick flexible fiber layer 10 is prevented from being distributed unevenly when in use.

4. The positioning wire 12 is stitched on the thick flexible fiber layer 10. The bonding effect of the graphite threads to the thick flexible fiber layer 10 is better than the prior art. The graphite threads are flat, flexible and less-weight. Therefore, after the graphite threads are added to the thick flexible fiber layer 10, the flexibility thereof would substantially unchanged.

Figure 4:
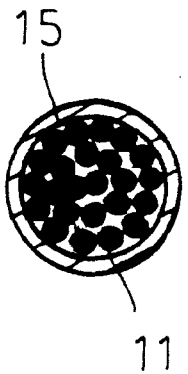
FIG. 4 is a cross-sectional view showing the graphite thread wrapped with a Teflon cover according to one preferred embodiment of the invention, taken along a diameter direction of the graphite thread.
Figure 5:
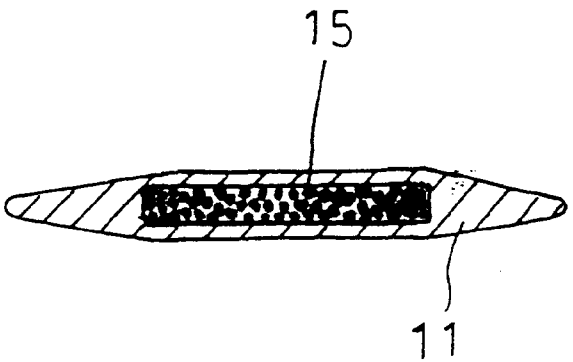
FIG. 5 is a cross-sectional view showing the graphite thread wrapped with a Teflon cover according to one preferred embodiment of the invention, taken along a axial direction of the graphite thread.

The graphite threads can be optionally enclosed with a silicone layer or flexible plastics 15, as shown in FIG. 4 or FIG. 5, for used in applications which prefer superior thermal performance.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A heating substrate comprising a flexible fiber layer and at least a graphite thread, wherein the graphite thread is formed by a plurality of graphite fibers, is wound on the flexible fiber layer and is fixed on the flexible fiber layer by use of a positioning wire wherein the positioning wire passes through the graphite threads at an angle, and the graphite thread is fixed on the flexible fiber layer by stitching the positioning wire to the flexible fiber layer along the length of the flexible fiber layer.

2. The heating substrate of claim 1, wherein a slot is formed at a given location on the flexible fiber layer, such that after wrappings enclose the whole flexible fiber layer, the portions of the wrappings on and under the flexible fiber layer are bound together.

3. The heating substrate of claim 1, wherein the graphite thread is wound in form of an "S" on the flexible fiber layer.

4. The heating substrate of claim 1, wherein the graphite thread is further enclosed with wrappings.

* * * * *